US007852171B2

(12) United States Patent
Das et al.

(10) Patent No.: US 7,852,171 B2
(45) Date of Patent: Dec. 14, 2010

(54) FILTER-ATTENUATOR CHIP DEVICE

(75) Inventors: Amitabh Das, State College, PA (US); Robert J. Hufnagel, Port Matilda, PA (US)

(73) Assignee: State of the Art, Inc., State College, PA (US)

( * ) Notice: Subject to any disclaimer, the term of this patent is extended or adjusted under 35 U.S.C. 154(b) by 198 days.

(21) Appl. No.: 12/046,861

(22) Filed: Mar. 12, 2008

(65) Prior Publication Data

US 2009/0231068 A1 Sep. 17, 2009

(51) Int. Cl.
*H01P 1/22* (2006.01)

(52) U.S. Cl. ..... 333/81 A

(58) Field of Classification Search ..... 333/81 R, 333/81 A

See application file for complete search history.

(56) References Cited

U.S. PATENT DOCUMENTS

| | | | | |
|---|---|---|---|---|
| 4,670,723 | A * | 6/1987 | Roland et al. | 333/81 A |
| 7,119,632 | B2 | 10/2006 | Blacka et al. | |
| 7,215,219 | B2 | 5/2007 | Roldan et al. | |
| 2009/0015355 | A1 * | 1/2009 | Zeeb | 333/81 A |

OTHER PUBLICATIONS

Lim et al, "A New Type of Low Pass Filter With Defected Ground Structure," Proc. 32d Eur. Microwave Conf., pp. 1-4, Oct. 2002.

Abdel-Rahman et al, "Compact Stub Type Microstrip Bandpass Filter Using Defected Ground Plane," IEEE Microwave and Wireless Components Letter, vol. 14, No. 4, Apr. 2004, pp. 136-138.

Mandal et al, "An Improved Low Pass Filter Microstrip Defected Ground Structure," Proc. XXVIIIth Gen. Assbly. U.R.S.I., Oct. 2005.

Cho et al, "Small-Sized Quasi-Elliptic Function Microstrip Low Pass Filter Based on Defected Ground Structure and Open Stubs," Microwave Journal, Feb. 2004, 5 pages.

Chen et al, "Lowpass Filter Design of Hilbert Curve Ring Defected Ground Structure," Progress in Electromagnetics Research, PIER, 70, 2007, pp. 269-280.

Technical Data Sheet for "Surface Mount Chip Resistor Attenuator," Vishay Intertechnology, Inc., Oct. 2005.

* cited by examiner

*Primary Examiner*—Stephen E Jones
(74) *Attorney, Agent, or Firm*—Dann, Dorfman, Herrell and Skillman, P.C.

(57) ABSTRACT

A microchip device is disclosed that combines a signal attenuator and a frequency filter. An embodiment of the device includes an input contact, an output contact, and a ground contact formed on the surface of a substrate. Resistive elements formed on the substrate interconnect the contacts. At least the input contact includes a gap pattern formed therein that is dimensioned and arranged such that the input contact provides a reactive impedance characteristic. The combination of the resistance of the resistive elements and the reactive impedance characteristic of the input contact are selected to provide attenuation and frequency filtering of a high frequency signal input to the microchip device. A method of manufacturing the filter-attenuator microchip device is also described.

10 Claims, 8 Drawing Sheets

FILTER-ATTENUATOR CHIP DEVICE

FIELD OF THE INVENTION

This invention relates generally to a chip device for electronic systems that operate at radio and microwave frequencies, and in particular, to an electronic chip device that provides both attenuation and frequency filtering of a radio/microwave frequency signal that is input to the device.

BACKGROUND OF THE INVENTION

RF amplifiers, circulators, mixers, and other electronic devices which incorporate one or more filters and one or more attenuators are known. Although a filter and an attenuator may be used in such devices, the filter and the attenuator are made and used as discrete components. The need to use two different devices to accomplish the attenuation and filtering functions is a less than efficient use of available space in an electronic device. In view of the ever increasing demand for more compactness in large-scale integration electronic devices, it would be desirable to have a single microchip device which provides both signal attenuation and frequency filtering, but which requires less space than two discrete devices.

The manufacturing of chips that provide only signal attenuation is different from the manufacturing of chips that provide only frequency filtering. Therefore, it would also be desirable to have a method for readily producing a chip device that provides both attenuation and filtering functions.

SUMMARY OF THE INVENTION

In accordance with a first aspect of the present invention, there is provided a microchip device that performs signal attenuation and frequency filtering. A microchip according to the present invention includes a substrate having a surface. An input contact is formed on the surface of said substrate and an output contact is also formed on the surface of said substrate separate from the input contact. A first electrical resistor is formed on the surface of the substrate so as to electrically connect the input contact and the output contact. A ground contact is further formed on the surface of the substrate separate from the input and output contacts. A second electrical resistor formed on the surface of the substrate electrically connects the ground contact with the input contact. The input contact includes a pattern formed therein that is dimensioned and arranged such that the input contact provides a reactive impedance characteristic. The combination of the resistance of the first resistor, the resistance of the second resistor, and the reactive impedance characteristic of the input contact are selected to provide attenuation and frequency filtering of a high frequency signal input to said microchip device at the input contact.

In accordance with another aspect of the present invention there is provided a method of manufacturing a microchip that provides both signal attenuation and frequency filtering of a high frequency or rf signal. The method according to the present invention includes the steps of providing a substrate and depositing a layer of resistor material onto a surface of the substrate. A layer of conductive material is then deposited onto the layer of resistor material. The conductive layer is then etched to form an input contact, an output contact, and a ground contact. The layer of resistor material is etched to form a first resistive element and a second resistive element that operatively interconnect the input contact, the output contact, and the ground contact. A gap pattern is then etched into the input contact. The pattern is dimensioned and arranged such that the input contact provides a first reactive impedance characteristic. The first and second resistive elements are then trimmed such that the resistance of the first resistive element, the resistance of the second resistive element, and the first reactive impedance characteristic provide attenuation and frequency filtering of a high frequency signal.

BRIEF DESCRIPTION OF THE DRAWINGS

The foregoing summary as well as the following detailed description will be better understood when read in conjunction with the drawings wherein.

DETAILED DESCRIPTION

Figure 1:
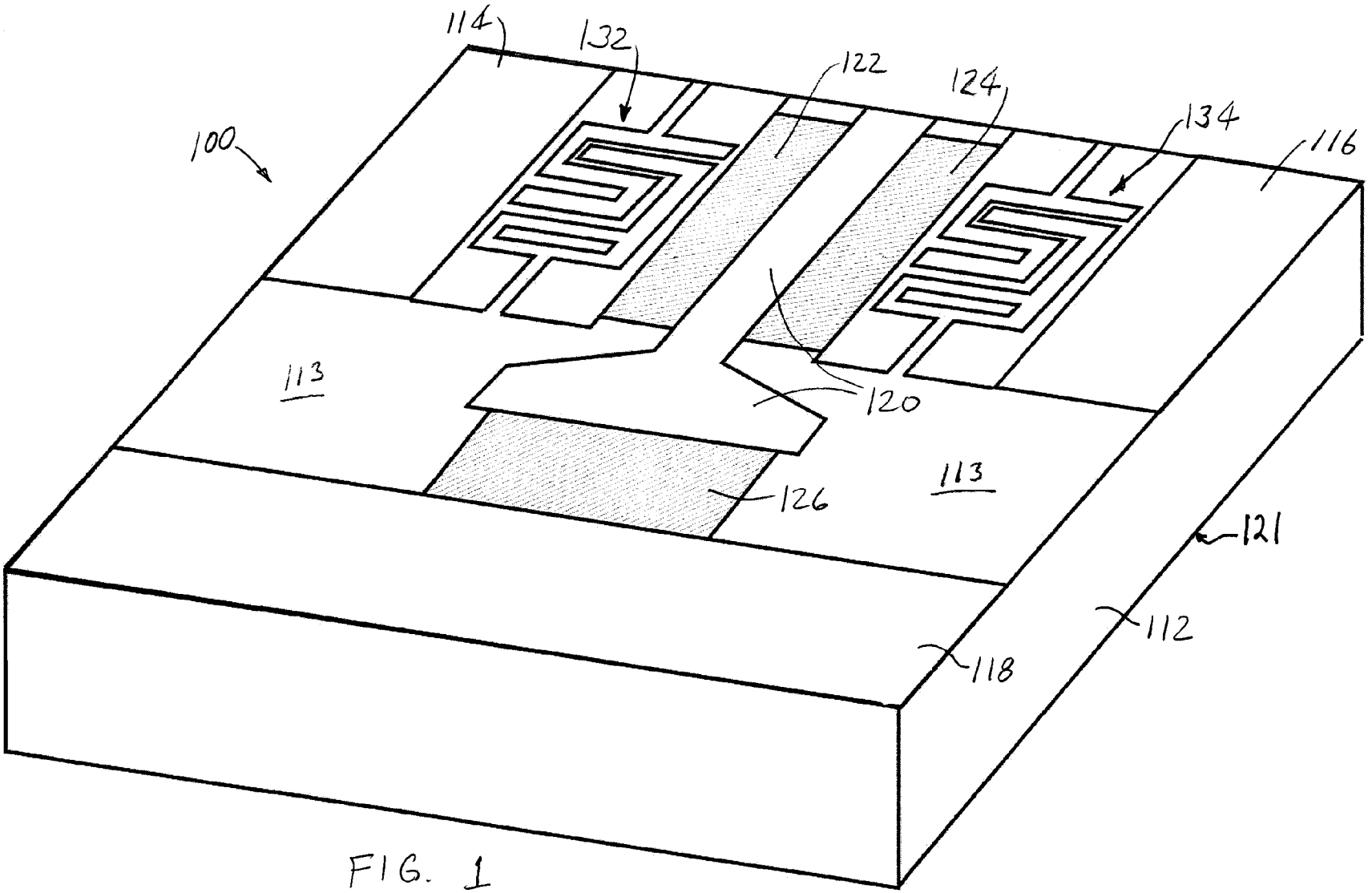
FIG. 1 is a top perspective view of a filter-attenuator chip in accordance with the present invention.

The chip device in accordance with the present invention is a chip package that provides both attenuation and frequency filtering of an rf signal input to the device. Referring now to the drawings, and in particular to FIG. 1, there is shown a first embodiment of a chip device according to this invention. The chip device 100 has a substrate 112 that includes a surface 113. The substrate 112 is preferably formed of a ceramic material such as alumina. It will be appreciated by those skilled in the art that the substrate may also be formed of other materials such as aluminum nitride, silica, or beryllium oxide.

Figure 7:
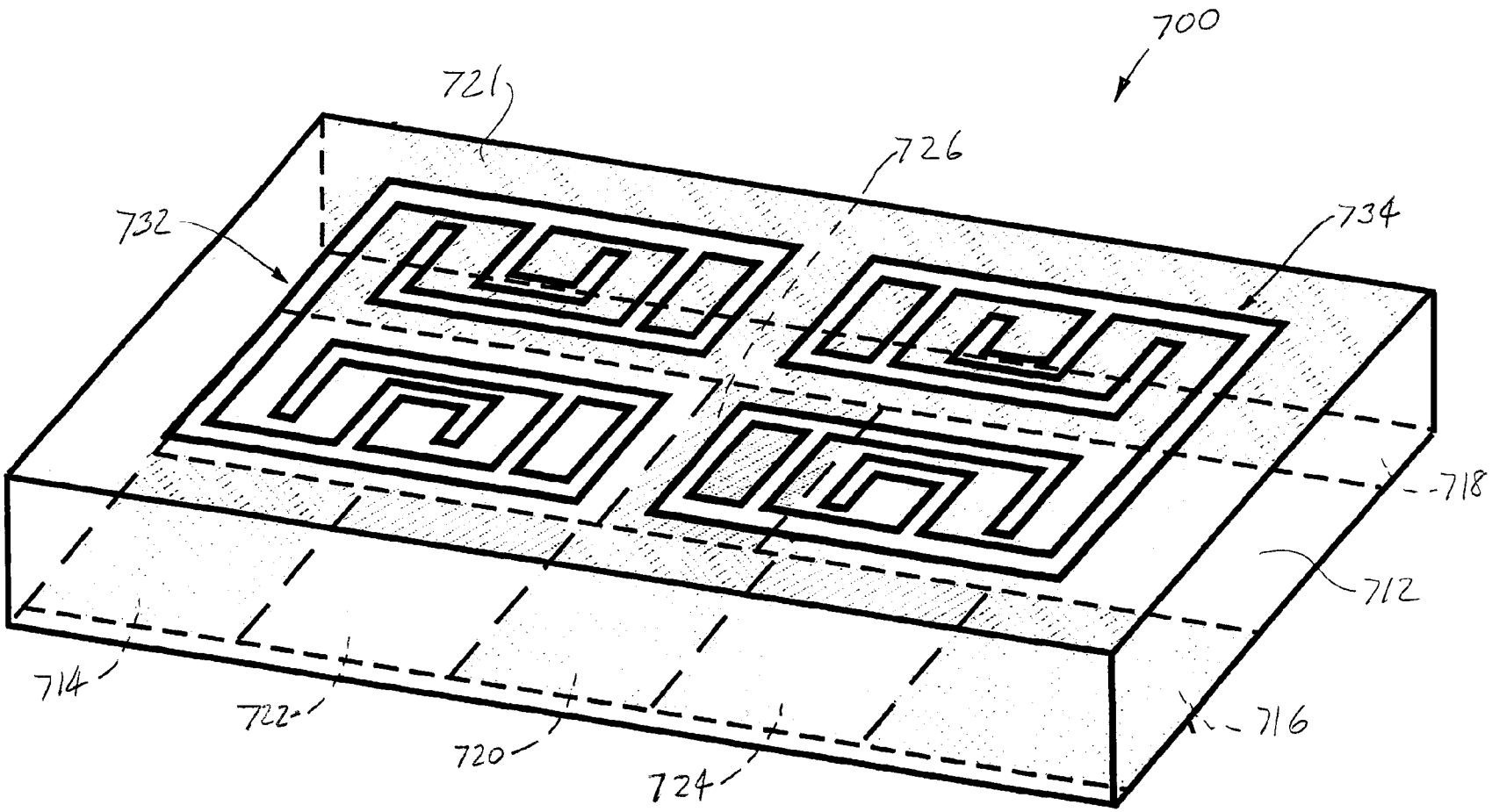
FIG. 7 is a bottom perspective view of an alternate embodiment of the filter-attenuator chip of FIGS. 1 and 3 wherein the reactance pattern is formed in the ground plane of the chip device.
Figure 8:
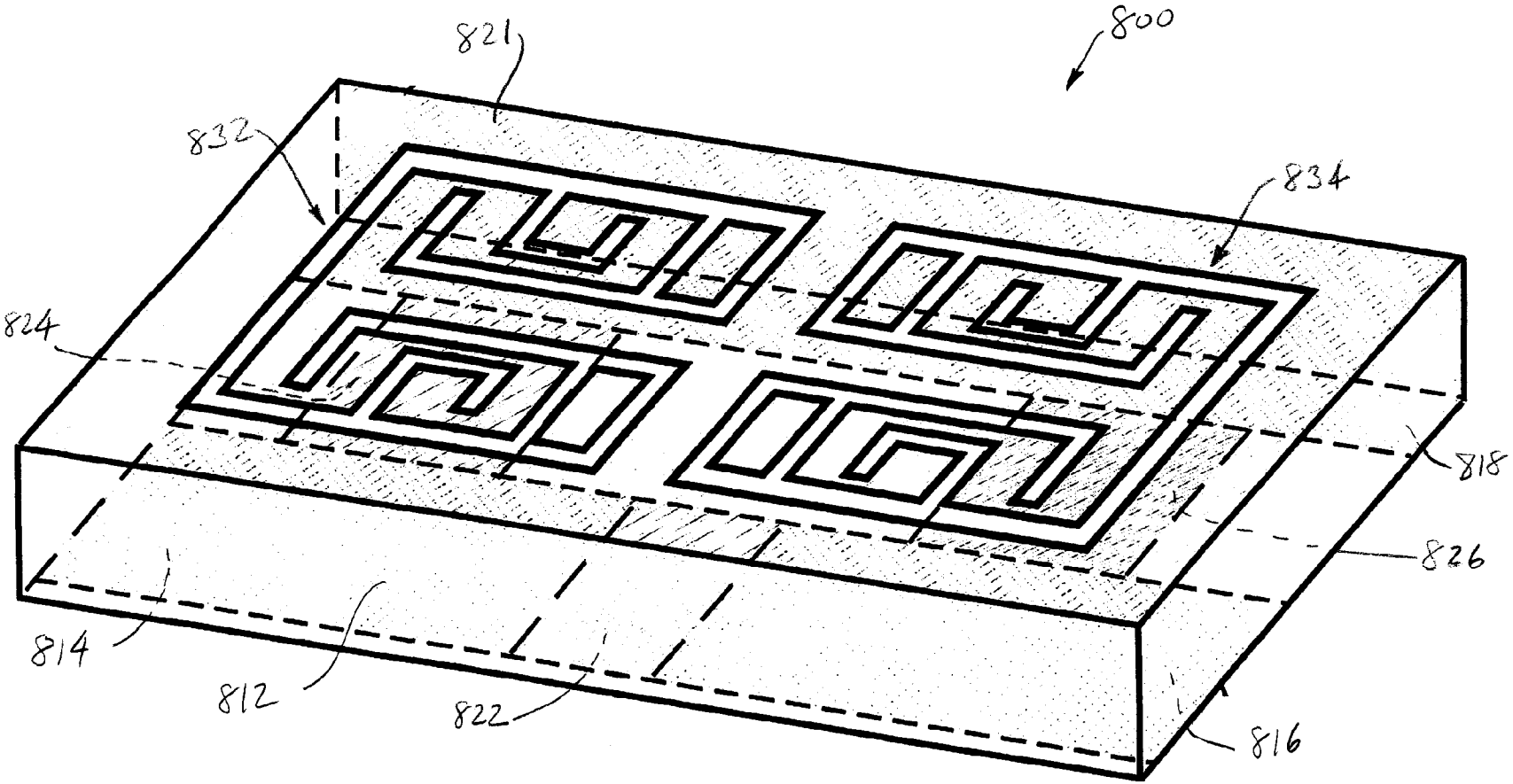
FIG. 8 is a bottom perspective view of an alternate embodiment of the filter-attenuator chip of FIG. 5 wherein the reactance pattern is formed in the ground plane of the chip device.

An input contact 114 is formed on the surface 113 of the substrate 112 at one end thereof. An output contact 116 is formed on the surface 113 at another end of the substrate 112 that is spaced from the input contact 114. A ground contact 118 is also formed on substrate surface 113 at a location that is spaced from both input contact 112 and output contact 116. An intermediate conductor 120 is formed on the substrate surface 113 at a location that is between and spaced apart from input contact 114, output contact 116, and ground contact 118. A metallized layer, as shown in FIGS. 7 and 8, is formed on the opposite surface 121 of the substrate. The contacts 114, 116, 118, 120, and the metallized ground plane layer are formed of a conductive metal such as gold, platinum, or an alloy thereof. The contacts and the ground plane may be plated with a nickel and solder layer. The conductive material is preferably deposited as a thin film, as described in greater detail hereinbelow. Alternatively, the conductive material can be deposited as a thick film in accordance with known thick-film printing techniques. When using thick films, the contacts and ground plane may be formed of a silver-platinum alloy, a silver-palladium alloy, or gold. The gold contacts may be coated with a nickel and solder material.

Referring again to FIGS. 1 and 3, a first resistive element 122 is formed on the substrate surface 113 such that it interconnects the input contact 114 and the intermediate contact 120. A second resistive element 124 is formed on the substrate surface 113 such that it interconnects the intermediate contact 120 and the output contact 116. A third resistive element 126 is provided on the substrate surface 113 such that it interconnects the intermediate contact 120 and the ground contact 118. The resistive elements 122, 124, and 126 are formed of an electrically resistive material that is preferably deposited as a thin film on the substrate surface. As in the case of the metal contacts, the resistive elements can be formed by using a thick-film technique.

A gap pattern 132 is formed in the input contact 114. Preferably, the gap pattern 132 is etched through the conductive material that forms input contact 114. The pattern 132 is configured and arranged to provide a reactance component to the impedance of the device 100. The reactance component provided by the pattern 132 in input contact 114 provides a frequency filtering capability. It is also contemplated that the pattern 132 can provide an aesthetic function when it is formed in a configuration that resembles a logo, design, or other visually desirable feature. The configuration of the pattern 132 is designed using known techniques. Preferably, the pattern is designed using circuit design software such as the Sonnet® Software developed and sold by Sonnett Software Inc. In accordance with this aspect of the present invention, it is contemplated that the reactance pattern 132 can be configured to provide low-pass filtering, high-pass filtering, band-pass filtering, or band-stop filtering of a high frequency signal that is input to the chip device.

As shown in FIG. 1, a second gap pattern 134 can be formed in the output contact 116. The second gap pattern 134 is configured to provide a second reactance component to the impedance of the device 100. The reactance patterns 132 and 134 are designed together to provide an overall reactance component of the impedance of the device 100 to provide the desired frequency filtering effect(s). The second pattern is designed and formed in the same manner as the first pattern 132.

Figure 2:
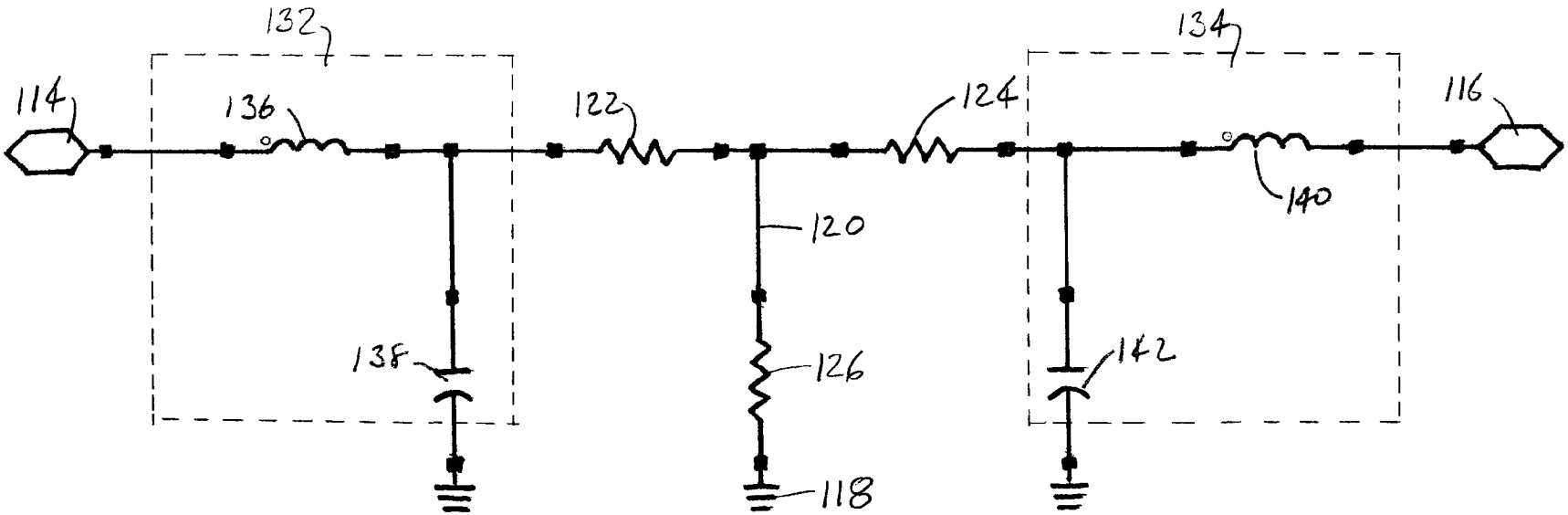
FIG. 2 is a schematic diagram of an equivalent circuit of the filter-attenuator chip shown in FIG. 1.

The filter-attenuator circuit realized by the combination of features that make up the chip device 100 is a "T" configuration. Referring now to FIG. 2, there is shown an equivalent circuit diagram of the filter-attenuator of chip device 100. It can be seen that the reactance pattern 132 provides an effective "L-C" circuit that includes an inductance element 136 and a capacitance element 138. Similarly, the reactance pattern 134 provides an effective L-C circuit that includes a second inductance element 140 and a second capacitance element 142. The resistive elements 122, 124, and 126 have electrical resistance values that are selected to provide attenuation of the signal input to the chip device at input contact 114. As will be appreciated from FIGS. 1 and 2 and the foregoing description, the chip device 100 provides both signal attenuation and frequency filtering in a single compact package.

Figure 3:
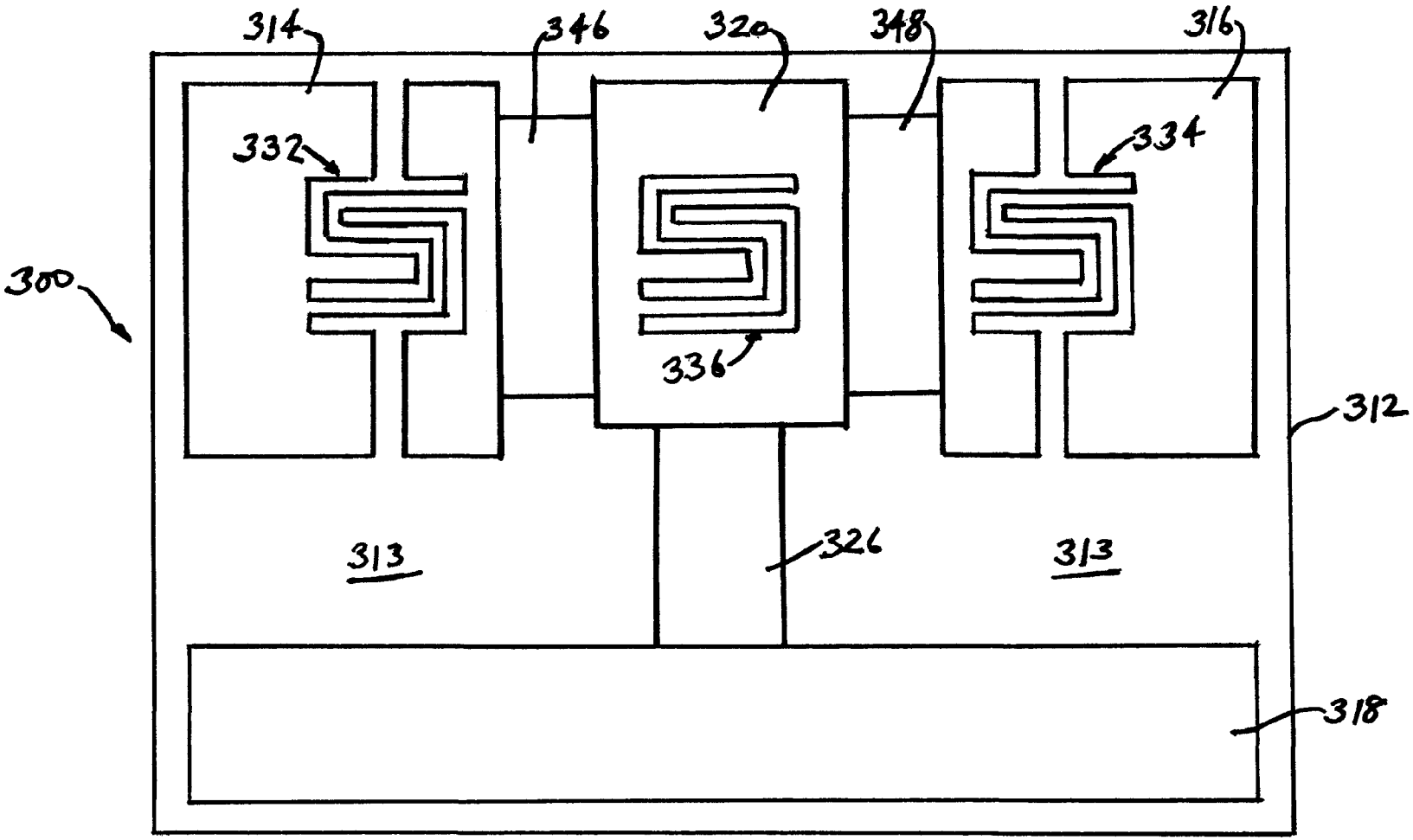
FIG. 3 is a top plan view of an alternate embodiment of the filter-attenuator chip of FIG. 1.

Referring now to FIG. 3, there is shown another embodiment of the filter-attenuator chip device of FIG. 1. The chip device 300 includes an input contact 314, an output contact 316, an intermediate contact 320, and a ground contact 318, all of which are formed on a surface 313 of substrate 312. Resistive element 346 interconnects the input contact 314 and the intermediate contact 320. Resistive element 348 interconnects the intermediate contact 320 and the output contact 316. Resistive element 326 interconnects the intermediate contact with the ground contact 318. A reactance pattern 332 is formed in the input contact 314 and a second reactance pattern 334 is formed in the output contact 316. In the embodiment shown in FIG. 3, a pattern 336 is formed in the intermediate contact 320. The pattern 336 can be designed to provide an additional reactance component to the impedance of the chip device by providing and additional effective L-C circuit. Alternatively, the pattern 336 can be formed solely for aesthetic purposes.

Figure 4:
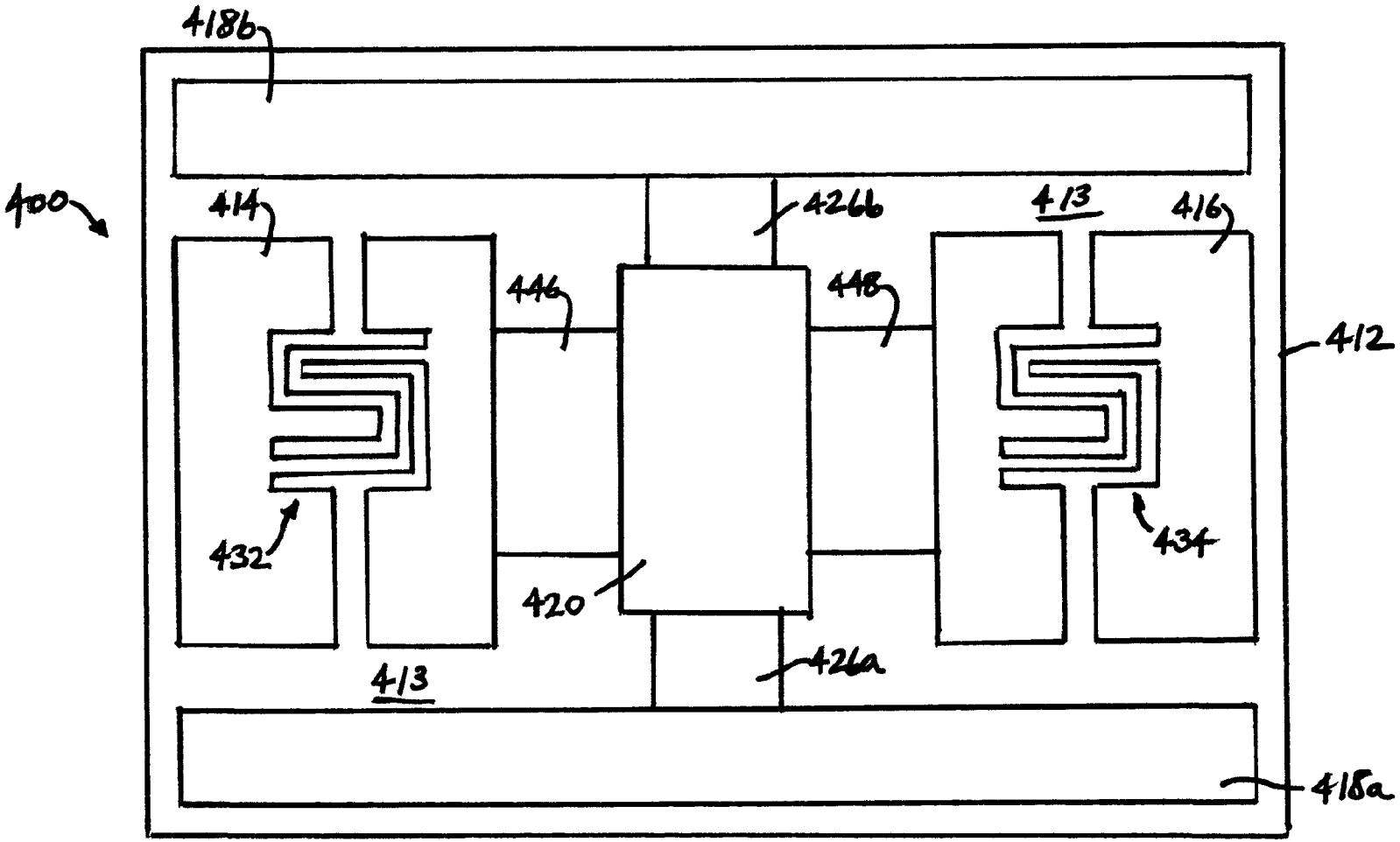
FIG. 4 is a top plan view of another embodiment of the filter-attenuator chip of FIG. 1.

Referring now to FIG. 4 there is shown a further embodiment of the filter-attenuator chip device of FIG. 1. The chip device shown in FIG. 4 is configured as a "Balanced-T" circuit. In this embodiment, the chip device 400 includes an input contact 414, an output contact 416, and an intermediate contact 420 formed on a surface 413 of a substrate 412. The chip device 400 also includes a first ground contact 418*a* and a second ground contact 418*b* formed on substrate surface 413. The ground contacts 418*a* and 418*b* are formed on opposite sides of the substrate surface 413 and spaced from the input contact 414, the output contact 416, and the intermediate contact 420. A resistive element 446 interconnects the input contact 414 and the intermediate contact 420. A second resistive element 448 interconnects the intermediate contact 420 and the output contact 416. A third resistive element 426*a* interconnects the intermediate contact 420 to the first ground contact 418*a* and a fourth resistive element 426*b* interconnects the intermediate contact 420 to the second ground contact 418*b*. A first reactance pattern 432 is formed in the input contact 414 and a second reactance pattern 434 is formed in the output contact 416. The reactance patterns 432 and 434, either alone or together, provide a reactance component to the overall impedance of the filter-attenuator device 400. The Balanced-T configuration of chip device 400 prevents cross talk between adjacent high frequency signals.

Figure 5:
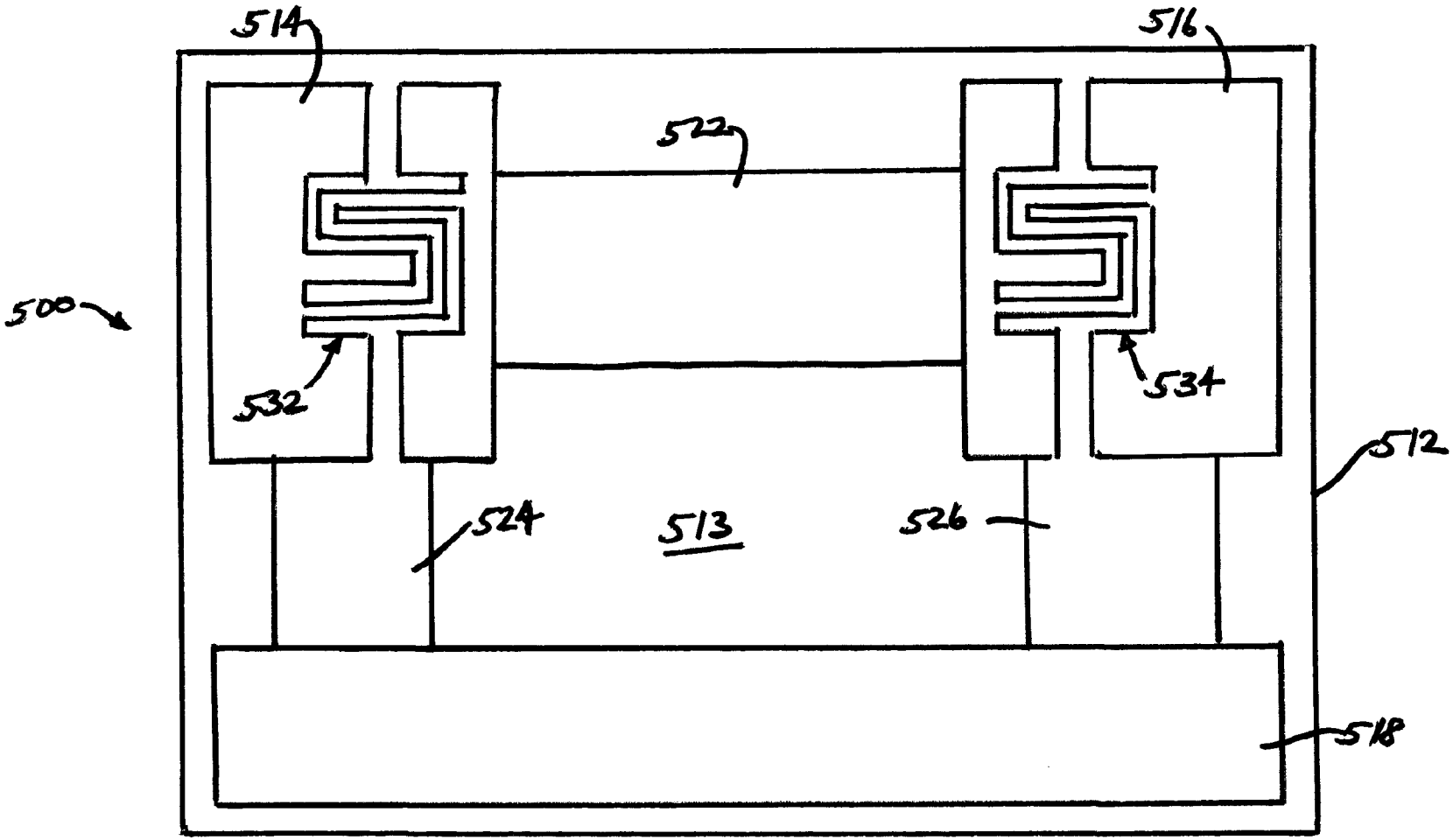
FIG. 5 is a top plan view of a further embodiment of a filter-attenuator chip according to the present invention.

Shown in FIG. 5 is another embodiment of a filter-attenuator chip device according to the present invention. The chip device shown in FIG. 5 is configured as a Π-type filter-attenuator circuit. An input contact 514 is formed on the surface 513 of the substrate 512 at one end thereof. An output contact 516 is formed on the substrate surface 513 at an opposite end of the substrate 512 that is spaced from the input contact 514. A ground contact 518 is also formed on substrate surface 513 at a location that is spaced from both input contact 514 and output contact 516.

A first resistive element 522 is formed on the substrate surface 513 such that it interconnects the input contact 514 and the output contact 516. A second resistive element 524 is formed on the substrate surface 513 such that it interconnects the input contact 514 and the ground contact 518. A third resistive element 526 is provided on the substrate surface 513 such that it interconnects the output contact 516 and the ground contact 518. A reactance pattern 532 is formed in the input contact 514. A second reactance pattern 534 may be formed in the output contact 516, as described above. The reactance patterns 532 and 534, either alone or together, provide a reactance component to the overall impedance of the filter-attenuator device 500.

Figure 6:
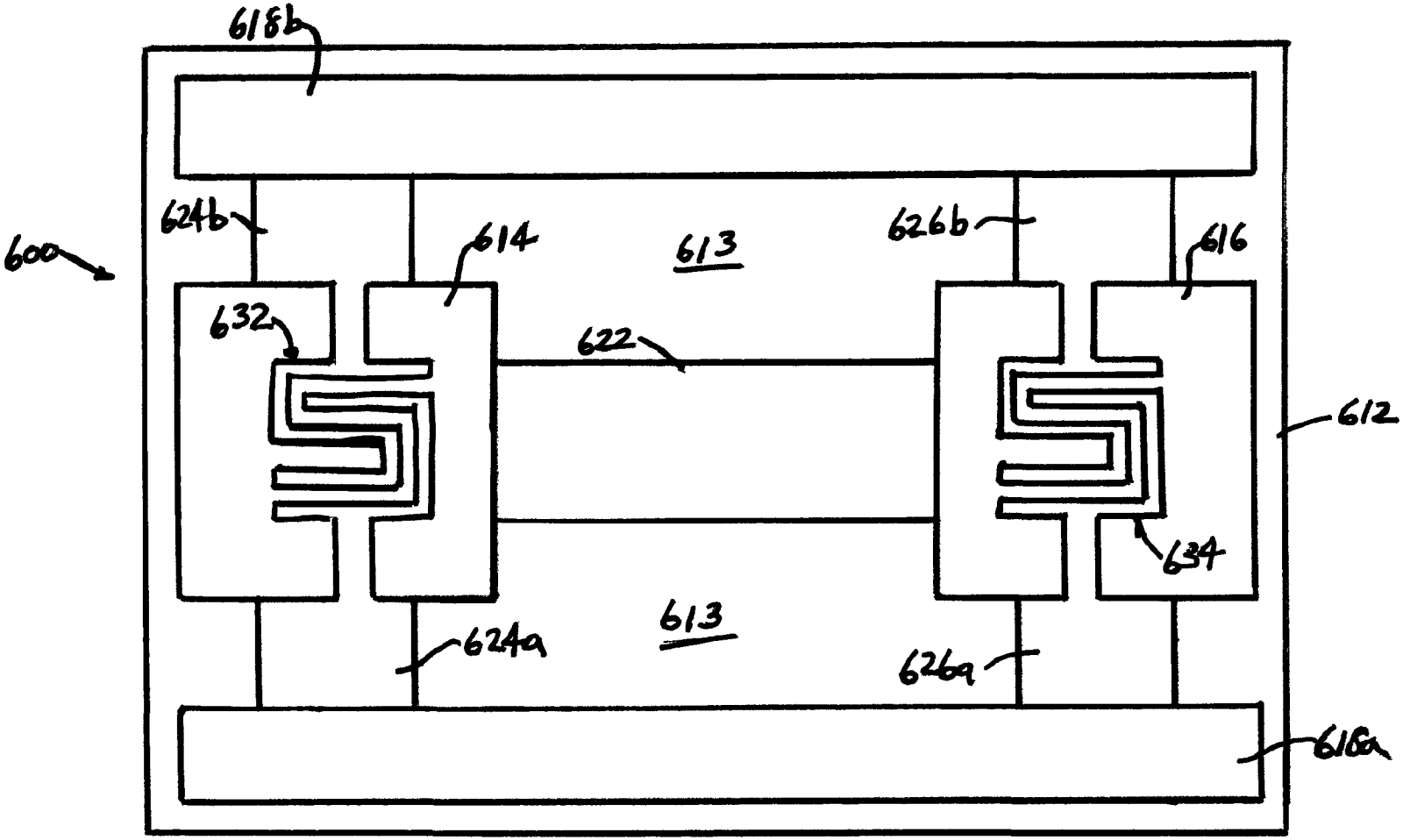
FIG. 6 is a top plan view of an alternate embodiment of the filter-attenuator chip of FIG. 5.

Referring now to FIG. 6 there is shown an alternative embodiment of the filter-attenuator chip device of FIG. 5. The embodiment shown in FIG. 6 is configured as a "Balanced-Π" circuit. In this embodiment, the chip device 600 includes an input contact 614 and an output contact 616 formed on a surface 613 of a substrate 612. The chip device 600 also includes a first ground contact 618*a* and a second ground contact 618*b* formed on substrate surface 613. The ground contacts 618*a* and 618*b* are formed on opposite ends of the substrate surface 613 and spaced from the input contact 614 and the output contact 616. A first resistive element 622 interconnects the input contact 614 and the output contact 616. A second resistive element 624*a* interconnects the input contact 614 and the first ground contact 628*a*. A third resistive element 624*b* interconnects the input contact 614 and the other ground contact 618*b*. A fourth resistive element 626*a* interconnects the output contact 616 to the first ground contact 618*a* and a fifth resistive element 626*b* interconnects the output contact 616 to the second ground contact 618*b*. A first reactance pattern 632 is formed in the input contact 614 and a second reactance pattern 634 may be formed in the output contact 616. The reactance patterns 632 and 634, either alone or together, provide a reactance component to the overall impedance of the filter-attenuator device 600. The Balanced-Π configuration of chip device 600 prevents cross talk between adjacent high frequency signals.

The foregoing descriptions are directed to embodiments of a filter-attenuator chip device in accordance with the present invention which can be used alone or as building blocks for more complex devices. Thus, the inventors contemplate that the various embodiments described can be combined as needed to provide desired levels of signal attenuation and frequency filtering for a particular application.

A method for making a filter-attenuator chip device in accordance with this invention will now be described. The process begins with the selection of an appropriate substrate material. Although the preferred substrate material is alumina, other non-conductive materials can also be used. In this regard, ceramic materials such as aluminum nitride, silica, beryllium oxide, and glass-ceramic composites can be used.

A layer of electrically resistive material is deposited on a surface of the substrate. Next, one or more layers of electrically conductive material is deposited over the resistive layer. The resistive and conductive layers are preferably deposited as thin films. The deposition steps are performed in a vacuum. A photo-sensitive material known as a photoresist is spin-coated onto the multiple layers. An etch pattern is formed on the photoresist using ultraviolet (uv) lithography, a well known technique. The metallic layers are then etched through the patterned photoresist to form the contacts and conductive paths of the chip device. The photoresist is then stripped away and a new coating of photoresist is applied. The second photoresist coating is patterned, again using uv lithography. The resistive material is then dry etched through the openings in the pattern to form the geometries of the resistive elements and to form the reactance patterns for each chip. The dry etching is preferably performed by an ion milling technique. The remaining photoresist is then removed.

The resistive elements are trimmed to final value by any known technique, preferably by laser trimming. Preferably, the chip device is passivated with a polymer to protect it from contamination or physical damage. The substrate is then scored with a laser and separated into individual chip devices.

Although the preferred process has been described as including thin film techniques, the inventors believe that the filter-attenuator device according to this invention can be made by thick film printing techniques also. In the case of thick film technology, the substrate is scored or scribed using a laser. Then the conductor patterns are screen printed and sintered onto the substrate surface. Next the reactance patterns in the input and output contacts are formed. Then the resistor patterns are screen printed onto the substrate. One or more inks may be used depending on the resistor values desired.

Further, the reactance element of the filter-attenuator chip of this invention can be implemented by providing patterned defects in the ground plane on the back side of the device. The defected ground structures are formed by etching a metallized layer on the ground plane of the chip device in a pattern that is dimensioned and arranged to provide a desired reactance characteristic. Referring now to FIG. 7, there is shown a T-type filter-attenuator chip device 700 having a defected ground structure to provide the reactance element. The chip 700 has a metallized layer 721 formed on the surface of the substrate 712 that is opposite the signal plane surface. Input contact 714, output contact 716, ground contact 718, intermediate conductor 720, and resistive elements 722, 724, and 726 are formed on the signal plane surface of the chip substrate 712. In the embodiment shown in FIG. 7, a first reactance element 732 and a second reactance element 734 are etched into the metallized layer 721.

Similarly, as shown in FIG. 8, a Π-type filter-attenuator chip 800 has a metallized layer 821 formed on the surface of the substrate 812 that is opposite the signal plane surface. Input contact 814, output contact 816, ground contact 818, and resistive elements 822, 824, and 826 are formed on the signal plane surface of the chip substrate 812. In the embodiment shown in FIG. 8, a first reactance element 832 and a second reactance element 834 are etched into the metallized layer 821.

It will be recognized by those skilled in the art that changes or modifications may be made to the above-described embodiments without departing from the broad inventive concepts of the invention. It is understood, therefore, that the invention is not limited to the particular embodiments that are described, but is intended to cover all modifications and changes within the scope and spirit of the invention as described above and set forth in the appended claims.

What is claimed is:

1. A microchip device comprising:

a substrate having a surface;

an input contact formed on the surface of said substrate;

an output contact formed on the surface of said substrate separate from said input contact, a first electrical resistor formed on the surface of said substrate and connecting said input contact and said output contact;

a ground contact formed on the surface of said substrate separate from said input contact and said output contact;

a second electrical resistor formed on the surface of said substrate and connecting said first resistor with said ground contact; and a pattern formed in said input contact, said pattern being dimensioned and arranged to provide an effective L-C circuit in said input contact having a first reactive impedance; and wherein the resistance of said first resistor, the resistance of said second resistor, and the reactive impedance are selected to provide attenuation and frequency filtering of a high frequency signal input to said microchip device.

2. A microchip device as claimed in claim 1 wherein the pattern formed in said input contact is a gap pattern.

3. A microchip device as claimed in claim 1 wherein the first electrical resistor comprises first and second resistance segments and the microchip device comprises a metallic conductor interconnecting said first and second resistance segments and said second electrical resistor.

4. A microchip device as claimed in claim 1 comprising:

a second ground contact formed on the surface of said substrate separate from said input contact, said output contact, and said ground contact;

a third electrical resistor formed on the surface of said substrate and connecting said second ground contact and said first electrical resistor;

wherein the resistances of said first, second, and third resistors, and the first reactive impedance are selected to provide attenuation and frequency filtering of a high frequency signal input to said microchip device.

5. A microchip device as claimed in claim 4 wherein said first electrical resistor comprises first and second resistance segments and said microchip device comprises a metallic conductor that interconnects said first and second resistance segments with said second and third electrical resistors, wherein the resistances of said first and second resistance segments, the resistances of said second and third resistors, and the first reactive impedance are selected to provide attenuation and frequency filtering of a high frequency signal input to said microchip device.

6. A microchip device as claimed in claim 1 comprising:

a second pattern formed in said output contact, said second pattern being dimensioned and arranged to provide a second effective L-C circuit in said output contact having a second reactive impedance;

wherein the resistance of said first resistor, the resistance of said second resistor, and the first and second reactive impedances are selected to provide attenuation and frequency filtering of a high frequency signal input to said microchip device.

7. A microchip device as claimed in claim 6 wherein the second pattern formed in said output contact is a gap pattern.

8. A microchip device as claimed in claim 6 wherein the first electrical resistor comprises first and second resistance segments and the microchip device comprises a metallic conductor interconnecting said first and second resistance segments and said second electrical resistor.

9. A microchip device as claimed in claim 6 comprising:

a second ground contact formed on the surface of said substrate separate from said input contact, said output contact, and said ground contact;

a third electrical resistor formed on the surface of said substrate and connecting said second ground contact and said first electrical resistor;

wherein the resistances of said first, second, and third resistors, and the first and second reactive impedances are selected to provide attenuation and frequency filtering of a high frequency signal input to said microchip device.

10. A microchip device as claimed in claim 9 wherein said first electrical resistor comprises first and second resistance segments and said microchip device comprises a metallic conductor that interconnects said first and second resistance segments with said second and third electrical resistors, wherein the resistances of said first and second resistance segments, the resistances of said second and third resistors, and the first and second reactive impedances are selected to provide attenuation and frequency filtering of a high frequency signal input to said microchip device.

* * * * *